US006814597B1

(12) United States Patent
Kao

(10) Patent No.: US 6,814,597 B1
(45) Date of Patent: Nov. 9, 2004

(54) SUBSCRIBER IDENTITY MODULE (SIM) CARD CONNECTOR WITH EJECTOR

(75) Inventor: Yi Chiu Kao, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 10/664,954

(22) Filed: Sep. 22, 2003

(51) Int. Cl.[7] ..... H01R 13/62

(52) U.S. Cl. ..... 439/159; 439/630; 439/155; 439/923

(58) Field of Search ..... 439/159–160, 439/155, 157, 923, 629–630

(56) References Cited

U.S. PATENT DOCUMENTS 5,197,894 A * 3/1993 Koike ..... 439/159
5,304,070 A * 4/1994 Bertho et al. ..... 439/157
6,027,350 A * 2/2000 Chen et al. ..... 439/159
6,319,028 B1 * 11/2001 Zhang et al. ..... 439/159
6,379,167 B1 * 4/2002 Zhang et al. ..... 439/157
6,592,385 B1 * 7/2003 Chen ..... 439/159
6,619,971 B1 * 9/2003 Chen ..... 439/159

* cited by examiner

*Primary Examiner*—Truc T. T. Nguyen
(74) *Attorney, Agent, or Firm*—Rosenberg, Klein & Lee

(57) ABSTRACT

A Subscriber Identity Module (SIM) card connector with ejector includes a housing, a plurality of contacts which is brought into contact with an external contact of the card inserted in the housing, and an ejector. The housing forms a card receiving space on one side for containing the SIM card and an ejector receiving groove on the other side for containing the ejector. The ejector comprises a slider which moves in the direction of card insertion or ejection, a push rod, and a lever. The slider has a push portion extending into the card receiving space. The lever can pivot in the groove. One side of the lever separately engages with the push rod and can be pushed to rotate by the push rod. The other side of the lever engages with the slider, therefore the slider can be driven to slide when the lever rotates. In the process of ejection, when a user presses the push rod, the push rod will carry the lever rotation together, the slider moves in accordance with the lever rotation in the direction of card releasing, and the push portion of the slider drives the SIM card to move, therefore the SIM card is released from the connector.

14 Claims, 3 Drawing Sheets

SUBSCRIBER IDENTITY MODULE (SIM) CARD CONNECTOR WITH EJECTOR

FIELD OF THE INVENTION

The invention generally relates to a Subscriber Identity Module (SIM) card connector equipped with mobile phone, and more particularly to a Subscriber Identity Module (SIM) card connector with ejector.

BACKGROUND OF THE INVENTION

Nowadays, a mobile phone code generally corresponds to a SIM (Subscriber Identity Module) card. A user can not operate the phone unless the user gets the corresponding SIM card. The common mobile communication system identifies each user according to the SIM card. Furthermore, as a storage medium, the SIM card can store data such as communication records, telephone code, user's name and so on.

Generally, mobile phone has a SIM card connector which electrically connects with phone's PCB (Printed Circuit Board), and the SIM card can freely insert into the SIM card connector and electrically connect with the mobile phone.

Conventional SIM card connector has a flexible slip pushed on the SIM card so that the SIM card is fastened in the connector. When a user wants to take the SIM card from the connector, he will remove the flexible slip, and then his finger pushes the SIM card out. Since SIM card and SIM card connector have a small volume, the user's finger is not able to take the SIM card from the SIM card connector expediently. When the user overexerts on the SIM card, the SIM card will be damaged. Otherwise, the SIM card usually has a slick surface, and the user's finger isn't convenient to push the card while the finger is moist, therefore, the user often need other assistant tools to help to take card out. These difficulties spend users much time and effort energies.

SUMMARY OF THE INVENTION

An object of the present invention is to provide a Subscriber Identity Module (SIM) card connector with ejector so that a user directly uses the ejector to release the SIM card from connector, the user does not have to press directly on the SIM card surface and avoids damaging the SIM card.

In order to achieve the above object, there is essentially provided a Subscriber Identity Module (SIM) card connector with ejector which comprises a housing forming a card receiving space on one side thereof for containing the SIM card and an ejector receiving groove on the other side thereof for containing an ejector. The ejector receiving groove is divided into a slider groove and a push rod groove. A plurality of contacts contained in the card receiving space which electrically connect with the SIM card. The ejector contained in the ejector receiving groove which comprises a slider, a push rod and a lever. The slider is located in the slide groove which comprises a moving portion moving along the slide groove, a push portion extending into the card receiving space used for driving the SIM card, and a first adjacent portion placed on the moving portion. The push rod is placed in the push rod groove. One end of the push rod is a second adjacent portion and the other end is a pushing portion. The lever is placed on the ejector receiving groove which has a first end placed on its one side and a second end placed on its other side, therein the first end engages with the first adjacent portion, the second end separately engages with the second adjacent portion. While a user presses the push rod to eject the SIM card, the second adjacent portion pushes the second end and the lever starts to rotate, the first adjacent portion thus pushes the first adjacent portion of the slider, the SIM card is driven by the push portion of the slider, and the SIM card finally released from the card connector.

In another aspect of the present invention, there is also provided an ejector equipped with ejector receiving groove of the card connector is used for releasing memory card from the memory card connector, there is also provided a slider which has a moving portion moving in ejector receiving groove, a push portion used for driving the memory card, and a first adjacent portion placed on the moving portion; a push rod, one end of the push rod is a second adjacent portion, other end is a pushing portion; and a lever placed on the ejector receiving groove which has a first end placed on its one side and a second end placed on its other side, wherein the first end engages with the first adjacent portion of said slider, the second end separately engages with the second adjacent portion of said push rod.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE INVENTION

Figure 1:
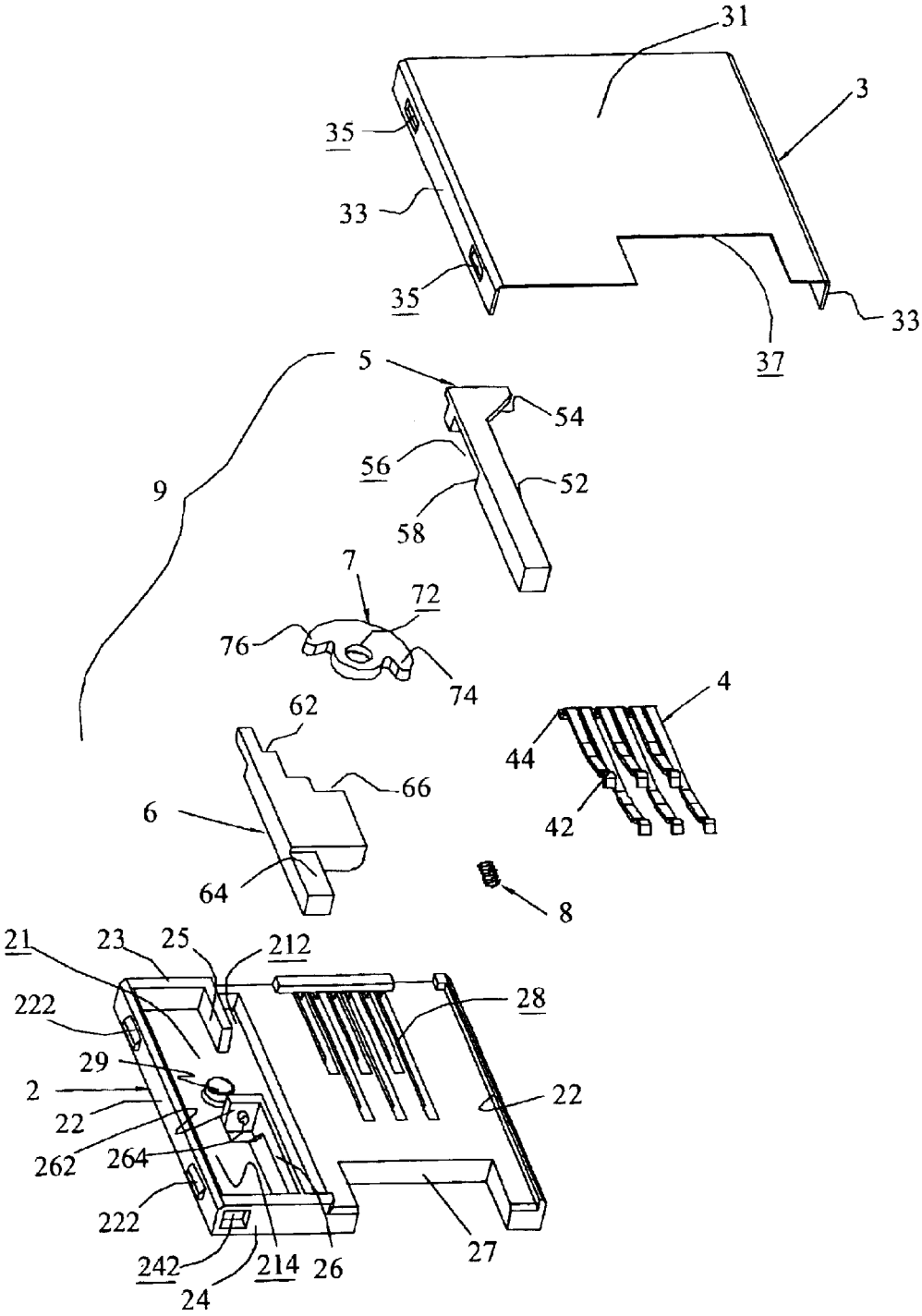
FIG. 1 is an exploded view of a preferred embodiment of the present invention.

Please refer to FIG. 1. A Subscriber Identity Module (SIM) card connector with ejector of the present invention comprises a housing 2, a cover 3, a plurality of contacts 4 and an ejector 9.

Figure 2:
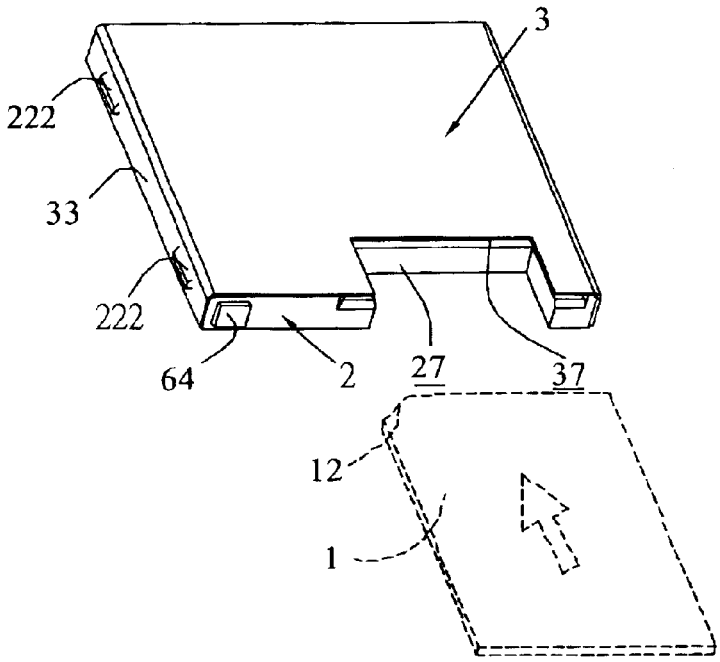
FIG. 2 is a perspective view of the preferred embodiment of the present invention.
Figure 4:
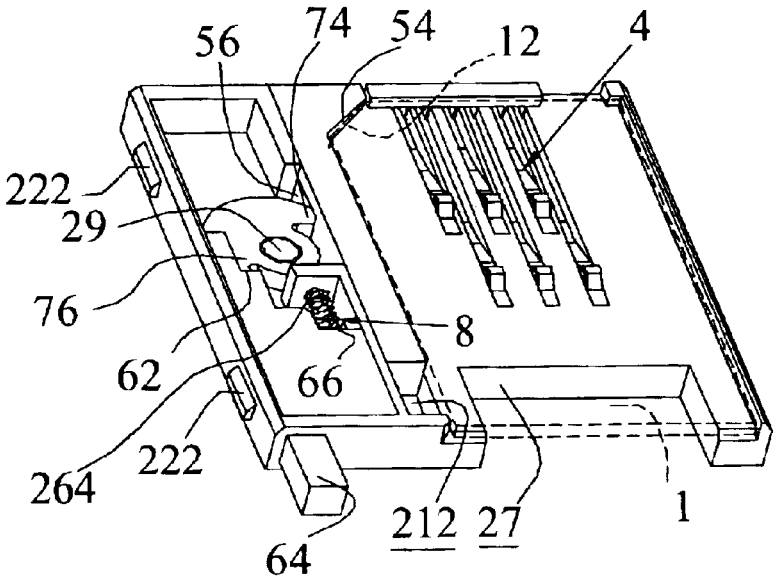
FIG. 4 is a perspective view of the preferred embodiment of the present invention with the cover removed showing the SIM card inserted thereinto.
Figure 5:
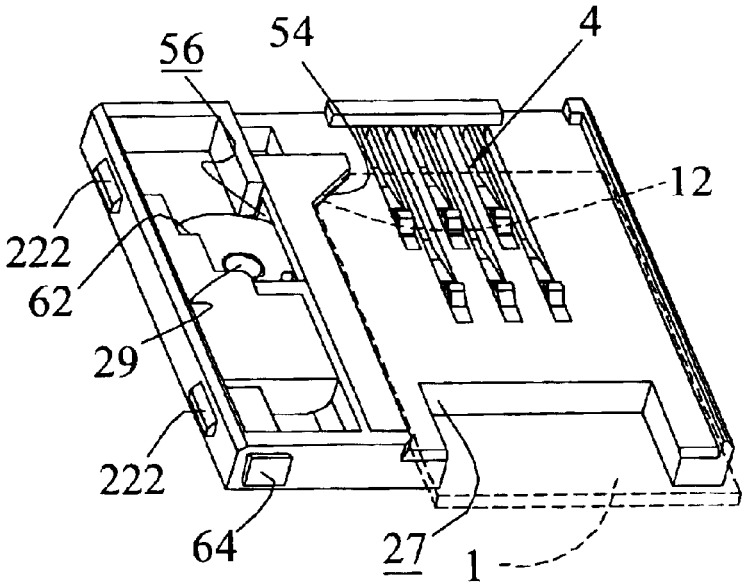
FIG. 5 is a perspective view of the preferred embodiment of the present invention with the cover removed showing the SIM card released therefrom.

The housing 2 forms a card receiving space on one side thereof for containing the SIM card 1 (as shown in FIG. 2, FIG. 4 and FIG. 5) and an ejector receiving groove 21 on the other side thereof for containing the ejector 9. The card receiving space has a sidepiece 22 protruded from its lateral, a housing nick 27 placed on the back of the card receiving space, and a plurality of contact receiving groove 28 formed on the forepart of the card receiving space. The ejector receiving groove 21 also has a sidepiece 22 protruded from its lateral, a front-wall 23 and a back-wall 24 respectively protruded from the front end and back end of the ejector receiving groove 21. The front-wall 23 and the back-wall 24 respectively has a front guiding board 25 and a back guiding board 26 spread from their body. The front guiding board 25 and the back guiding board 26 are parallel to the sidepiece 22. The ejector receiving groove 21 is divided into a slider groove 212 and a push rod groove 214 by the front guiding board 25 and the back guiding board 26. The back guiding board 26 has a bottom 262 perpendicularly extending into the push rod groove 214 from its forepart. A spring retaining projection 264 is placed on the bottom 262 towards the back-wall 24. A pivot 29 is located between the front guiding board 25 and the back guiding board 26. The sidepiece 22 has a plurality of protruding portions 222 on its external so that the housing 2 cooperates with the cover 3 (described later). A projecting hole 242 which opposites the push rod groove 214 is placed on the back-wall 24.

Figure 3:
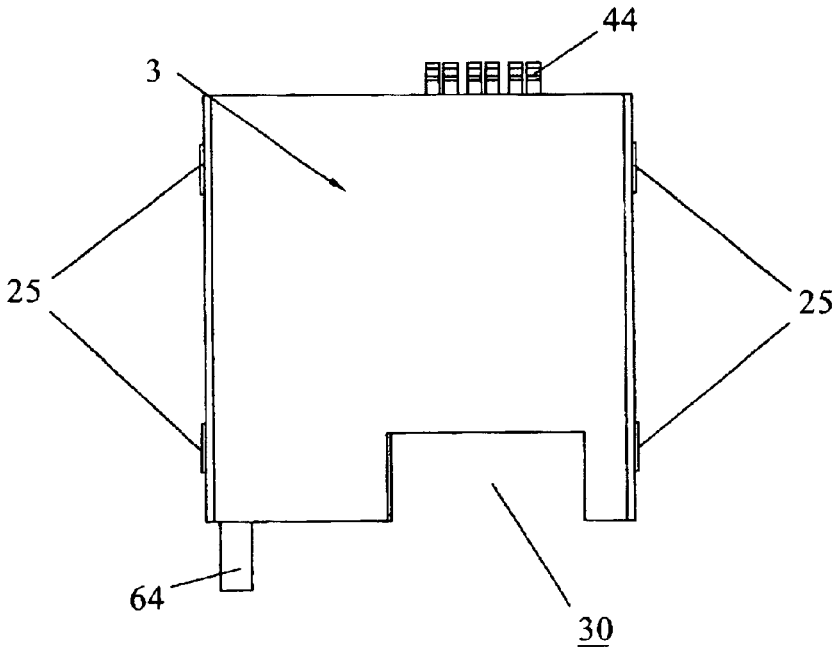
FIG. 3 is a plan view of the preferred embodiment of the present invention for receiving a SIM card.

The cover 3 comprises a top plate 31, lateral piece 33 which perpendicularly extend from the top plate 31 towards the housing 2, a cover nick 37 which is opposite to the housing nick 27 formed on the back of the top plate 31, and a plurality of retaining holes 35 formed on the lateral piece 33 used to fastening with the protruding portion 222 so that the cover 37 overlaid on the housing 2. As shown in FIG. 2, the card receiving space therefore is formed, and the SIM card 1 can be inserted into the SIM card 1 connector in the arrow direction. Further, as shown in FIG. 3, a taking card nick 30 is formed corresponding to the cover nick 37 cooperated the housing nick 27. The space supplied by taking card nick 30 will help user expediently take the SIM card 1 being ejected.

Please refer to FIG. 1, FIG. 3 and FIG. 4, a plurality of contacts 4 is respectively inserted into the corresponding contact receiving grooves 28. Each contact 4 has a contacting portion 42 and a terminal portion 44. The contacting portion 42 is projected to the card receiving space in order to electrically connect with the SIM card 1 being inserted, and the terminal portion 44 extends outside the housing in order to electrically connect with phone's PCB (Printed Circuit Board).

Please refer to FIG. 1 and FIG. 4, the ejector 9 comprises a slider 5 which moves in the direction of card insertion or ejection, a push rod 6, a lever 7 and a spring 8. The slider 5 is located in the slide groove 212 which is placed on the housing 2. The slider 5 comprises a moving portion 52 moving along the slide groove 212, a push portion 54 extending into the card receiving space, and a concave groove 56 placed on the moving portion. One internal wall of the concave groove 56 is formed as a first adjacent portion 58. Usually, SIM card 1 has a bevel 12. When SIM card 1 inserts into the card receiving space, the bevel 12 will touch the push portion 54 of the slider 5 which is shaped as a bevel. The bevel 12 fits in with the push portion 54. In the case of the card inserting direction is wrong, the bevel of the push portion 54 will prevent the SIM card 1 insertion because other corner of the SIM card 1 are right angle. The push rod 6 is placed in the push rod groove 214, one end of the push rod 6 is a second adjacent portion 62, the other end of the push rod 6 is a pushing portion 64 which extends out from the projecting hole 242 for user pressing. A sidestep 66 is located between the second adjacent portion 62 and the pushing portion 64 towards the bottom 262. The sidestep may have a hole (not shown in the figure) so that one end of a spring 8 is contained in the hole, the other end of the spring 8 is engaged with the spring retaining projection 264. Therefore, the spring is located between the bottom 262 and the sidestep 66 and supplies spring force to return the push rod original position. The lever 7 has a first end 74 placed on its one side and a second end 76 placed on its other side. A pivot hole 72 which covers around the pivot 29 to make the lever located on the housing is located between the first end 74 and the second end 76. The first end 74 inserts into the concave groove 56 and engages with the first adjacent portion 58, the second end 76 separately engages with the second adjacent portion 62. While a user presses the push rod 6 to eject the SIM card 1, the second adjacent portion 62 pushes the second end 62, and the lever 7 starts to rotate, after the SIM card 1 released, the spring 8 returns the push rod 6 to the original position, the second adjacent portion 62 separates from the second end 76.

Please refer to FIG. 4 and FIG. 5, in the process of releasing the SIM card 1, a user presses the pushing potion 64 to make the push rod 6 moved forwardly, the second adjacent portion 62 touches the second end 76 and the lever 7 was driven to rotate. The first end 74 corresponding rotates, because the first end 74 engages with the first adjacent portion 58. therefore, the slider 5 is moved backwards. The SIM card 1 will be driven by the push portion 54 of the slider 5 and released from the connector.

The operation described above is simply and do not have to press directly on the SIM card surface, and the invention avoids damaging the SIM card.

This invention has been described with reference to specific embodiments, this description is not to be construed in a limiting sense. For example, those skilled in the art will recognize modifications and alterations which may be made to the embodiments illustrated herein. However, it is contemplated that such modifications can be made without departing the scope and spirit of the invention as defined in the following claims, for example, to apply the ejector disclosed as above to the design of other memory card connector should be the claim scope of the present invention.

What is claimed is:

1. A Subscriber Identity Module (SIM) card connector with ejector comprising:

a housing forming a card receiving space on one side thereof for containing the SIM card and an ejector receiving groove on the other side thereof, the ejector receiving groove being divided into a slider groove and a push rod groove;

a plurality of the contacts contained in the card receiving space which electrically connects with the SIM card; and an ejector contained within the housing and disposed in the ejector receiving groove thereof, the ejector including a slider located in the slide groove, a push rod, and a lever; the slider comprising a moving portion extending longitudinally along the slide groove for displacement therein, a push portion extending into the card receiving space for engaging the SIM card received therein, and a first adjacent portion formed on the moving portion; the push rod being placed in the push rod groove, one end of the push rod being a second adjacent portion, the other end being a pushing portion; the lever being disposed in pivotally displaceable manner in the ejector receiving groove, the lever having a first end and a second end the first end engaging the first adjacent portion of the slider the second end separately engaging the second adjacent portion of the push rod;

the lever being pivotally displaced responsive to a user pressing the push rod to impart a responsive pressing force upon the moving portion of the slider, the slider being driven thereby to displace alone the slide groove, whereby the SIM card is driven outward from the card receiving space by the push portion of the slider to be expelled, from the card connector.

2. A Subscriber Identity Module (SIM) card connector with ejector as claimed in claim 1, wherein said ejector receiving groove has a pivot protruded therefrom, said lever has a pivot hole to receive the pivot and make the lever located in the housing.

3. A Subscriber Identity Module (SIM) card connector with ejector as claimed in claim 1, wherein a back guiding board has a bottom extending into the push rod groove and a sidestep located on the push rod, a spring being contained between the bottom and the sidestep.

4. A Subscriber Identity Module(SIM) card connector with ejector as claimed in claim 1, wherein said bottom has a spring retaining projection opposite to said sidestep for engaging the spring.

5. A Subscriber Identity Module(SIM) card connector with ejector as claimed in claim 1, wherein said sidestep has a hole towards said bottom for containing one side of the spring.

6. A Subscriber Identity Module(SIM) card connector with ejector as claimed in claim 1, wherein the housing has a projecting hole placed on its back part towards the push rod groove, so that the pushing portion extends out for user pressing.

7. A Subscriber Identity Module(SIM) card connector with ejector as claimed in claim 1 wherein said slider has a concave groove formed therein to define said first adjacent portion.

8. A Subscriber Identity Module(SIM) card connector with ejector as claimed in claim 1, wherein said push portion has an angled side for driving the SIM card having a beveled corner.

9. A Subscriber Identity Module(SIM) card connector with ejector as claimed in claim 1, further comprising a cover which covers the housing.

10. A Subscriber Identity Module(SIM) card connector with ejector as claimed in claim 9, wherein said cover has a cover nick placed on the back of the cover, said housing correspondingly has a housing nick, the cover nick and the housing nick form a taking card nick.

11. An ejector placed on an ejector receiving groove of a memory card connector used for expelling at least one memory card from the connector comprising:

a slider contained in a housing of the memory card connector and having a moving portion extending longitudinally along a slide groove in the ejector receiving groove for displacement therein, a push portion for engaging and driving an SIM card, and a first adjacent portion formed on the moving portion;

a push rod, one end of the push rod being a second adjacent portion, the other end being a pushing portion; and, a lever disposed in pivotally displaceable manner in the ejector receiving groove, the lever having a first end and a second end, wherein the first end engages with the first adjacent portion of said slider, the second end separately engages with the second adjacent portion of said push rode;

the lever being pivotally displaced responsive to manipulation of the push rod to impart a responsive pressing force upon the moving portion of the slider, the slider being driven thereby to displace along the slide groove, whereby the card is driven outward by the push portion of the slider to be expelled from the card connector.

12. An ejector as claimed in claim 11, further comprising a spring located in the ejection receiving groove for biasing the push rod.

13. An ejector as claimed in claim 11, wherein said slider has formed therein a concave groove defining, said first adjacent portion.

14. An ejector as claimed in claim 11, wherein said push portion has an angled side used for driving the SIM card having a beveled corner.

* * * * *